United States Patent [19]

Sargent et al.

[11] 4,185,340

[45] Jan. 29, 1980

[54] TOILET APPARATUS

[75] Inventors: Frank T. Sargent; Arthur W. Henke; John M. Antos, all of Ann Arbor; John T. Cameron, Dearborn Hts., all of Mich.

[73] Assignee: Thetford Corporation, Ann Arbor, Mich.

[21] Appl. No.: 962,898

[22] Filed: Nov. 22, 1978

[51] Int. Cl.[2] ..... E03D 5/01; E03D 5/012; E03D 5/09

[52] U.S. Cl. ..... 4/441; 4/442; 4/438; 4/300; 4/435

[58] Field of Search ..... 4/441, 438, 442, 435, 4/440, 128, 129, 132, 115, 300, 317-319, 323, DIG. 14, DIG. 19, 116, 114, 321; 251/203

[56] References Cited

U.S. PATENT DOCUMENTS

| | | | |
|---|---|---|---|
| 3,566,418 | 3/1971 | Carlson et al. | 4/441 |
| 3,781,920 | 1/1974 | Browne et al. | 4/441 |
| 3,798,681 | 3/1974 | Johansen | 4/440 |
| 3,883,903 | 5/1975 | Vanden Broek | 4/440 |
| 3,939,500 | 2/1976 | Miller et al. | 4/442 |
| 3,949,431 | 4/1976 | Morgan | 4/440 |
| 4,032,996 | 7/1977 | Sargent et al. | 4/441 |
| 4,142,261 | 3/1979 | Johansen | 4/442 |

*Primary Examiner*—Henry K. Artis
*Attorney, Agent, or Firm*—Olsen and Stephenson

[57] ABSTRACT

Toilet apparatus that has a plurality of improved features including: a sealing mechanism for closing the bottom opening of a toilet bowl so that the effectiveness of the seal is maintained over extended periods of time, a flushing circuit that has a water reservoir that assures proper depth is achieved in the pool of water that is formed after the sealing mechanism is closed, an over flow tube which assures that the water seal therein is maintained, and a control valve which has an inlet fitting that assures that damage to the valve or related parts does not occur during installation of the toilet apparatus.

17 Claims, 17 Drawing Figures

Fig-13
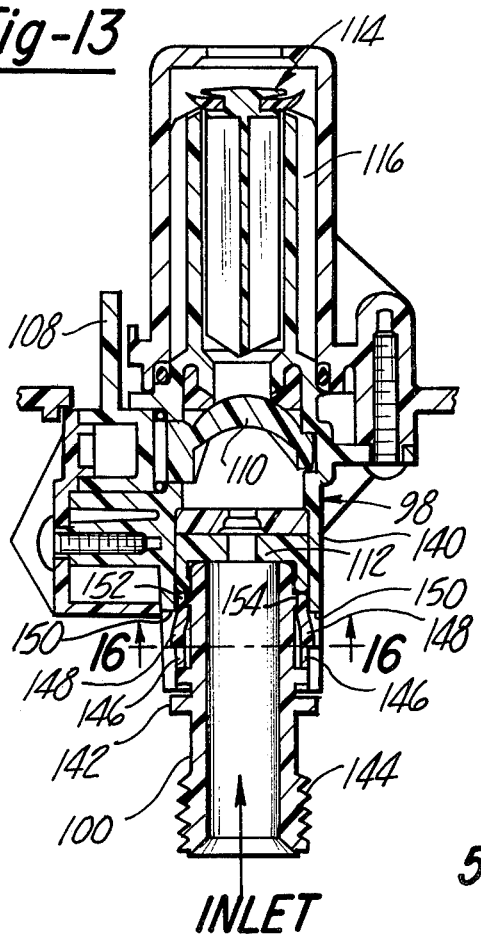
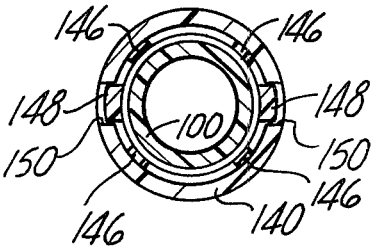
Fig-16
Fig-3
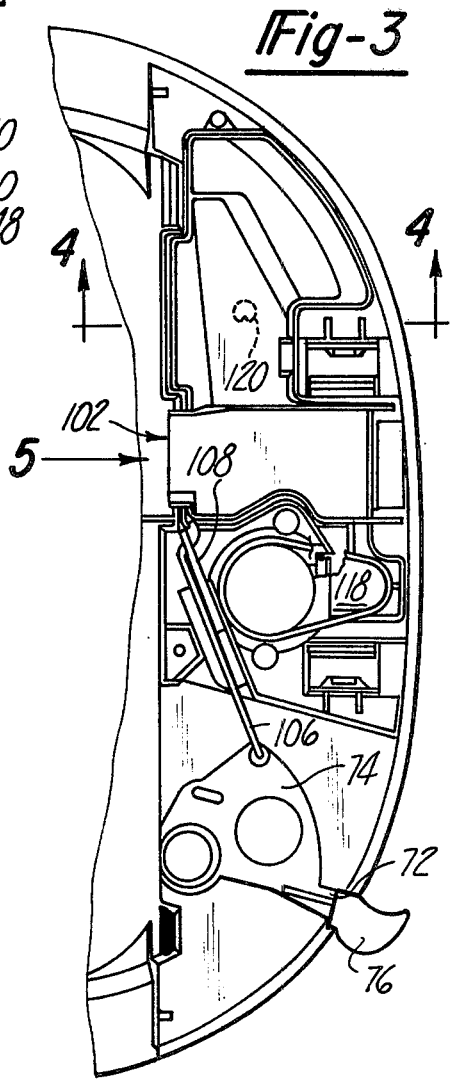
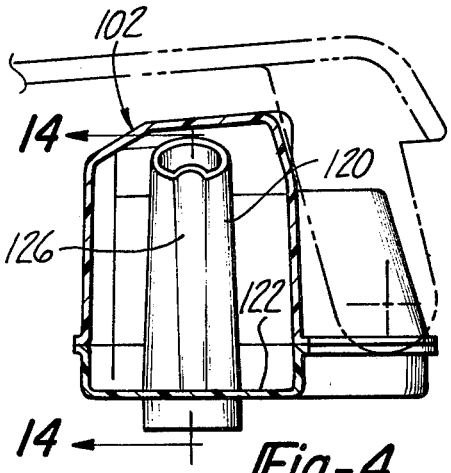
Fig-4

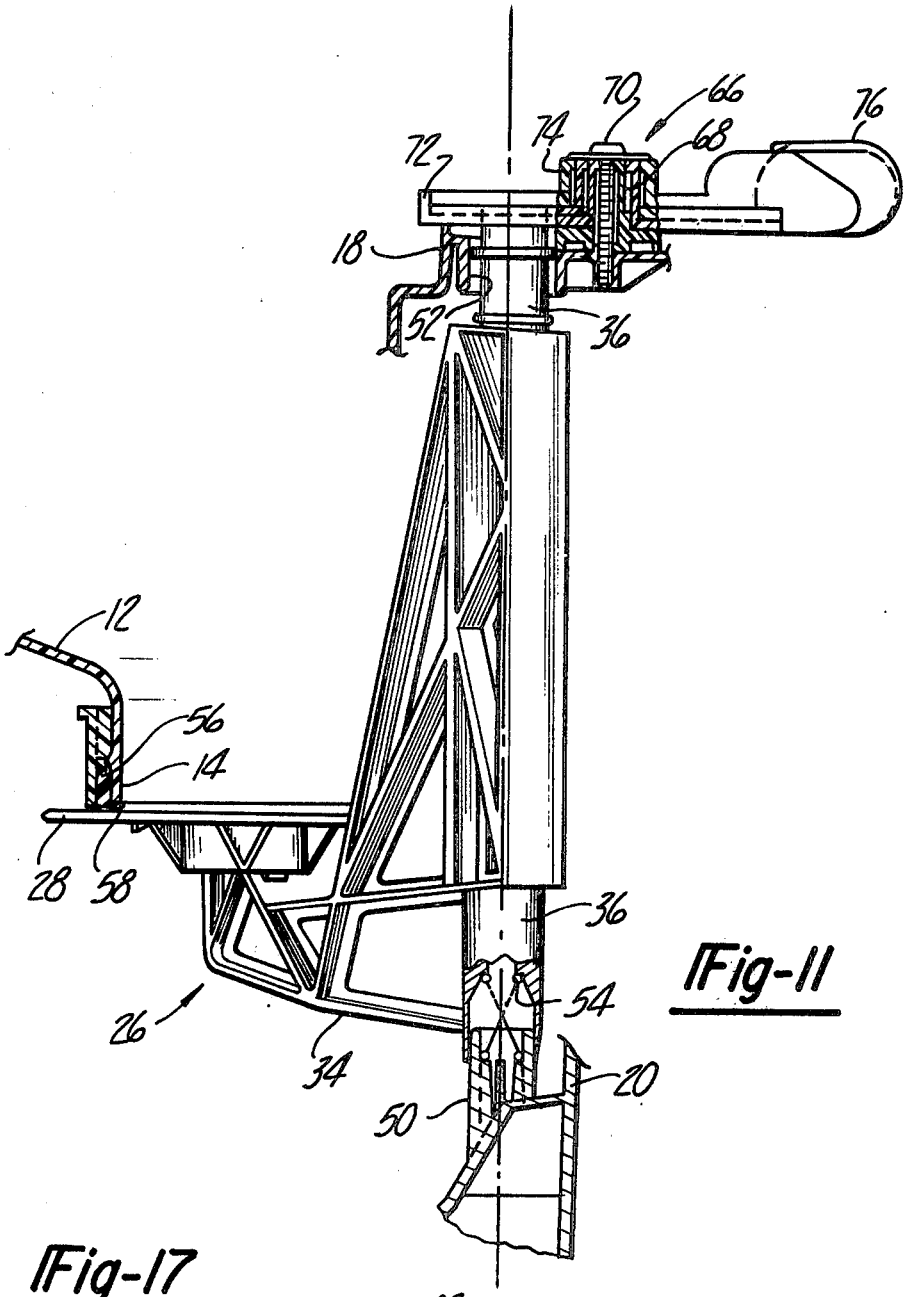
Fig-11
Fig-17
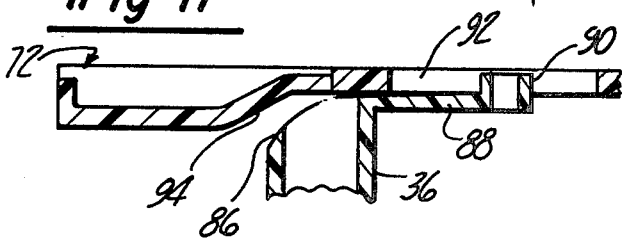

TOILET APPARATUS

BACKGROUND OF THE INVENTION

The present invention relates to improvements in sealing mechanisms for toilets and to flush means associated therewith. In particular, the invention pertains to toilets of the type wherein the toilet bowl discharges to a holding tank and a closure member is provided for opening and closing the discharge outlet from the bowl to the holding tank. In toilets of this character, which may be used in mobile homes, recreational vehicles, marine vessels and the like, the closure member must function to provide a sealed closure of the discharge outlet except during the flushing cycle of the toilet.

Known toilets of the type to which the present invention relates are disclosed, for example, in U.S. Pat. Nos. 3,939,500 and 4,032,996. The former patent discloses toilet apparatus wherein a pan serves to close the discharge outlet and a flush means cooperates with the pan to provide a water seal at the closed discharge outlet. The flush means provides an accumulation chamber which functions to discharge a volume of water into the pan after the flushing operation is terminated to fill the pan partially to form the water seal. A ball valve in the flush circuit is operatively connected with the actuator mechanism for pivoting the pan during the flushing so that flush water will flow to the bowl when the pan is pivoted to its open position.

U.S. Pat. No. 4,032,996 discloses a sealing mechanism for the discharge outlet of the toilet bowl wherein a blade is pivoted generally in a horizontal plane between a closed position wherein the blade is seated against an elastomeric sleeve projecting downward from the outlet, and movement of the blade provides a wiping action on the surface of the blade.

SUMMARY OF THE INVENTION

The present invention is directed toward improvements in various of the features embodied in the toilet apparatus disclosed in the above-cited U.S. Pat. Nos. 3,939,500 and 4,032,996.

According to one form of the present invention, a toilet apparatus is provided having a bowl with a discharge outlet at the bottom, a housing supporting the bowl, flush means for discharging flush water into the bowl, and a sealing mechanism for closing and opening the bowl outlet, the sealing mechanism having a seal member mounted on the bowl around the outlet and projecting downward below the lower extremity of the outlet, a blade of larger area than said bowl outlet, and an actuator arm for movement of the blade between a first position wherein said blade is located under the bowl outlet and is urged upward into engagement with the seal member for closing the bottom of the bowl and a second position wherein said blade is at one side of the outlet.

One of the features of the present invention is that actuating means for opening and closing the bowl outlet are provided which are operatively associated with the actuator arm and the blade, the actuating means being operable when actuated for opening the bowl outlet to reduce initially the magnitude of the upward pressure of the blade on the sealing member to a pressure of lower magnitude and thereafter to move the blade substantially horizontally toward the second position while the pressure of lower magnitude exerted by the blade on the sealing member is maintained. This feature assures that the blade remains in an engaged position at a preselected lower pressure with the sealing member so that the blade is properly wiped and so that a buildup of undesirable materials on the surface of the blade is avoided.

Another feature of the present invention is the construction and arrangement that is provided whereby an overflow tube assembly is arranged in association with the flush means so that a water seal is assured at all times in the overflow tube and limited quantities of water are provided for discharge onto the top surface of the blade when in its open position. For this purpose a check valve is positioned at the lower end of the overflow tube to allow limited quantities of water to be discharged from the tube while preventing return flow or pressure surges from breaking the water seal above in the overflow tube.

Still another feature of the invention is a track means that is mounted on the lower end of the bowl and extends to one side thereof. The track means includes an enclosure in which the lower end of the overflow tube and its check valve are enclosed, and the enclosure is open at the bottom to provide tracks at its lower edges on which the blade can travel to and from its open position, thereby also assuring that the blade will remain in its proper position on the actuator arm.

The improved features in the flush means of the present invention includes the construction and arrangement of the control valve in the flush water circuit, whereby the inlet end of the control valve can be connected to a water supply duct without concern about causing damage to the valve or the supporting housing on which the valve is mounted. Damage of this type has frequently occurred in the past when wrenches are used to tighten the fittings when connecting the inlet duct to the valve. The significant feature embodied in the present invention provides a fitting which fits into the valve body so that the fitting will turn freely therein but will be retained against axial displacement. To permit securing the inlet duct to the freely rotatable fitting, a wrench head is made an integral part of the fitting so that the jaws of a wrench can be fitted into the wrench head to hold the fitting against turning, and thereby, the wrench will absorb the torque that is applied to the fitting for fastening the inlet duct thereto.

The present invention has still another feature in that a reservoir is provided in the flush circuit so that a standard quantity of water will always flow into the bowl after the flush operation is terminated, thereby assuring that a uniform depth of water is provided in the bowl after the blade has assumed its closed position. For this purpose a riser tube extending through the bottom wall of the reservoir forms the only outlet from the reservoir to a flush tube leading to a discharge nozzle in the bowl. When the valve in the flush circuit is open, flush water can fill the reservoir to the level of the open upper end of the tube after which rapid flow of flush water to the nozzle will occur, the tube having a small orifice adjacent to the bottom wall of the reservoir so that after the valve is closed and the level of the water is at or below the upper end of the tube the remaining water in the reservoir can flow at a slow rate to the nozzle and from there into the bottom of the closed bowl.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 3 is an enlarged fragmentary top plan view;

FIG. 4 is an enlarged fragmentary section taken on the lines 4—4, showing the riser tube in the reservoir;

FIG. 11 is a fragmentary sectional view taken on the lines 11—11 of FIG. 7;

FIG. 13 is a fragmentary sectional view taken through the control valve;

FIG. 16 is a sectional view taken on the lines 16—16 of FIG. 13; and

FIG. 17 is a fragmentary sectional view taken on the lines 17—17 of FIG. 8.

DESCRIPTION OF THE PREFERRED EMBODIMENT

Figure 1:
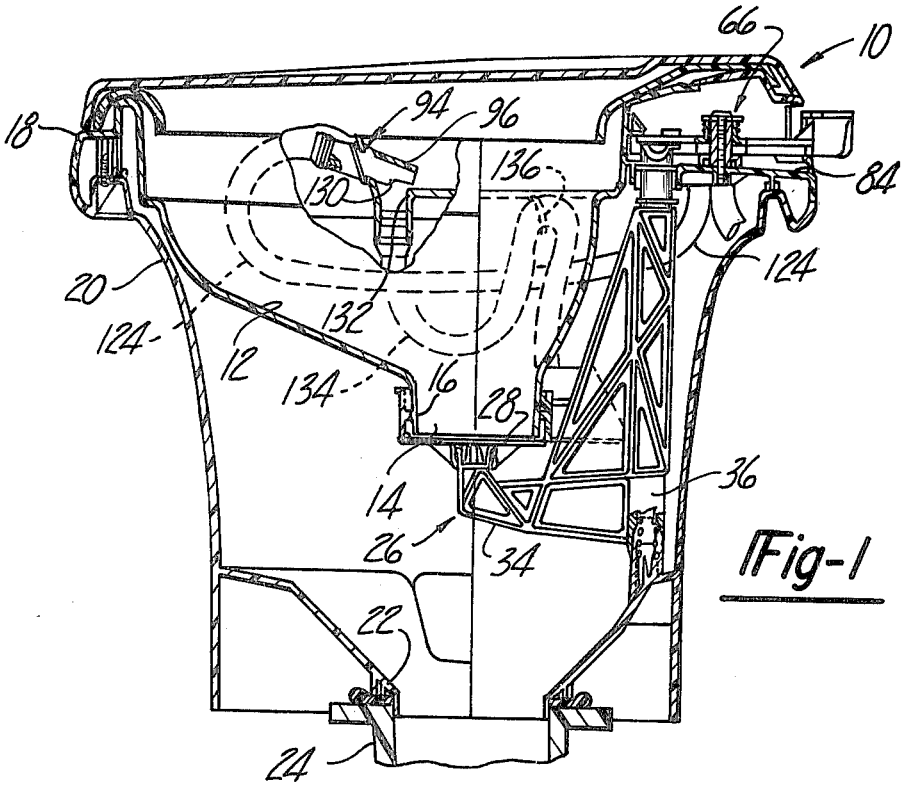
FIG. 1 is a vertical sectional view, with parts broken away for illustrational purposes, of a toilet apparatus embodying the present invention.
Figure 2:
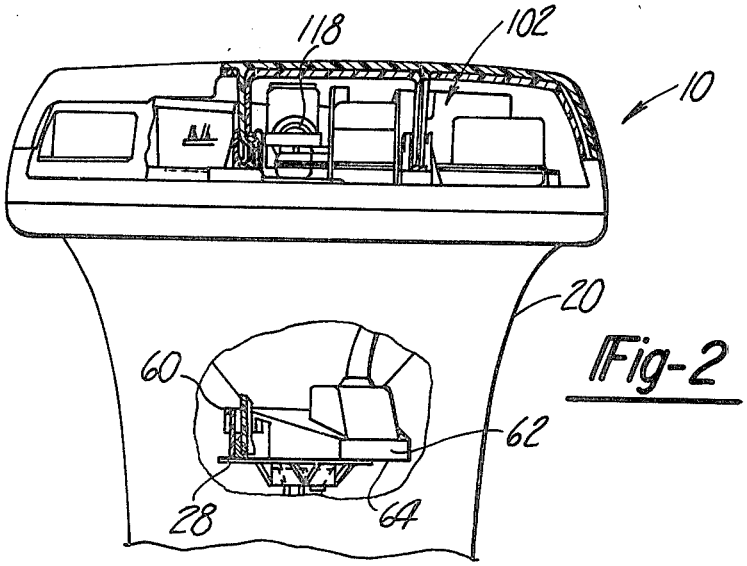
FIG. 2 is a fragmentary rear elevational view with portions broken away for illustrational purposes.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The toilet apparatus 10 comprises the bowl 12 having at its bottom a discharge outlet 14 defined by the downwardly projecting flange 16. The upper end of the bowl 12 is open and has an outwardly directed peripheral flange 18 that is supported on and is secured to the housing 20. The housing 20 defines an outlet 22 leading to a holding tank (not shown) via the conduit 24. Waste material from the bowl 12 can be discharged through the outlet 22 when the sealing mechanism 26 is in an open position.

Figure 10:
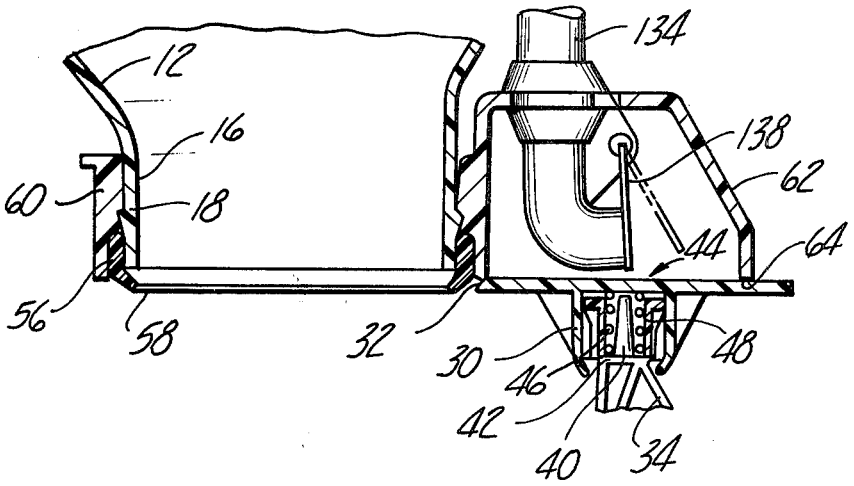
FIG. 10 is a fragmentary sectional view of the lower end of the bowl taken on the lines 10—10 of FIG. 9.

The sealing mechanism 26 can move between open and closed positions for opening and closing the bowl outlet 16. The sealing mechanism 26 includes a blade 28, and it has a downwardly opening socket 30, FIG. 10, located centrally of the blade 28 and a beveled edge 32 around the periphery of the blade 28. The sealing mechanism also includes a crank arm 34 that has a shaft portion 36 providing an essentially vertical axis about which the crank arm 34 can pivot. The crank arm 34 also has a finger 40 at its radially outer end for supporting the blade 28 surrounded by a collar 42 which extends into the socket 30. As best seen in FIG. 10, a secondary spring means 44, comprising a secondary coil spring 46 and a sleeve 48 for driving the blade horizontally between its open and closed positions, is seated on and integrally attached to the collar 42. In the illustrated position wherein the blade 28 is in its open position, the blade 28 is lifted off the finger 40 by the spring 46, and the latter is exerting a pressure of a relatively low magnitude against the blade 28. As will be explained hereafter, when the blade 28 is in its closed position shown in FIG. 1, the crank arm 34 will be in an elevated position causing the blade 28 to be seated on the finger 40, and a primary spring, to be described, will then exert upward pressure, through the crank arm 34 and thereby to the blade 28, of a higher magnitude.

Attention is direction next to FIG. 11 which shows the crank arm 34 when in the closed position of the blade 28. The shaft portion 36 is supported on the post 50 of the housing 20 and is guided for pivotal movement in the cylindrical bearing surface 52 of flange 18 which is integrally joined to housing 20. Primary spring means 54, comprising a coil spring capable of exerting greater spring forces than the secondary coil spring 46, is positioned between the post 50 and the shaft portion 36 to urge the crank arm 34 in an upward direction. Since the primary spring 54 has greater strength than the secondary spring 46, the primary spring 54 will overcome the secondary spring 46 causing the latter to collapse sufficiently so that blade 28 is seated on the finger 40 and the spring pressure of higher magnitude will then be imparted by the primary spring means 54 to the blade 28.

Figure 12:
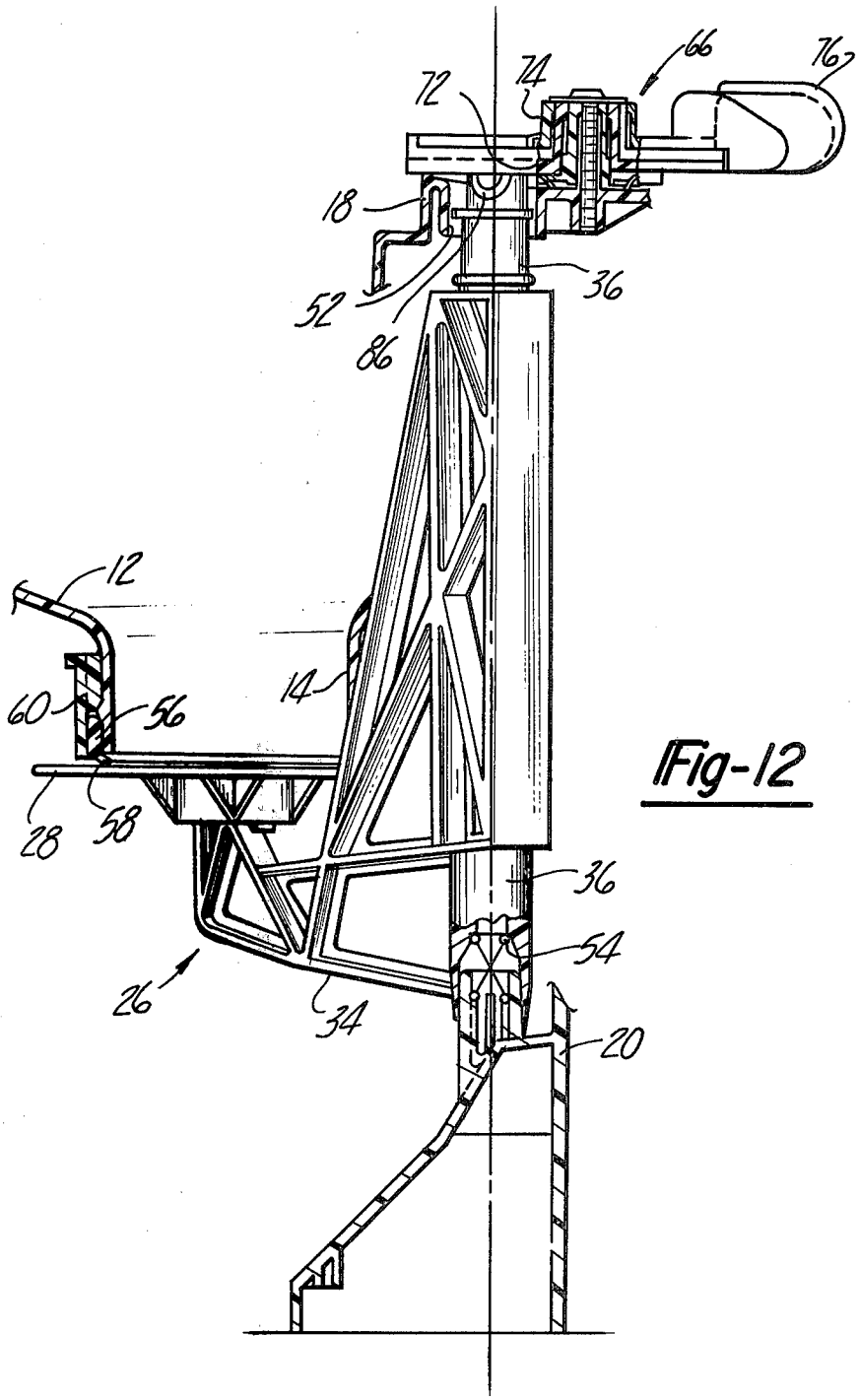
FIG. 12 is a fragmentary sectional view taken on the lines 12—12 of FIG. 8.

In a manner to be described hereafter, as an initial step in the flush cycle, the crank arm 34 is vertically or axially depressed to the position shown in FIG. 12. When this occurs, the primary spring means 54 is compressed, as shown, and the finger 40 and its collar 42 will be lowered an amount equal to the vertical movement of crank arm 34. By virtue of this action, the secondary spring means 44 will now become dominant and the blade 28 will be held in the elevated position shown in FIG. 10 because of the pressure of lower magnitude exerted by the secondary spring 46. Thus, when the primary spring means 54 is the dominant force acting on blade 28, a pressure of relative high magnitude is exerted and when secondary spring means 44 is the dominant force acting on blade 28, a pressure of lower magnitude is exerted on blade 28.

Also constituting a part of the sealing mechanism 26 is a seal member 56 that is mounted in a sealing relationship to the bottom of the bowl 12 around the outlet 14. The seal member 56 is an elastomeric sleeve which projects below the lower edge of the outlet 14 so as to provide an elastic curtain or a projecting portion 58 below the lower edge of the flange in a similar manner that is disclosed in the aforesaid U.S. Pat. No. 4,032,996. In its condition shown in FIG. 10, when the blade 28 has been moved to its open position, the projecting portion 58 provides an inward tapered lower edge. When the sealing mechanism 26 is in the closed position shown in FIGS. 1 and 11, the blade 28 will be urged upward against the projecting portion 58 of seal member 56 at the pressure of higher magnitude exerted by primary spring means 54, and when the actuating means, to be described, has caused the crank arm 34 to be axially displaced so that the secondary spring means 44 becomes the dominant spring force, the blade will be urged upward against the seal member 56 at the pressure of lower magnitude to the extent shown in FIG. 12. Now when the actuating means is further actuated, as will be described, the blade 28 will move horizontally in a plane that would contain the projecting portion 58 in a relatively lower stress condition. The upward pressure of lower magnitude assures uniform operation and proper wiping action at a preset pressure. It also assures proper maintenance of the blade on track means to one side of the outlet 14.

The seal member 56 is enclosed around its outer periphery by a collar 60 that is snap-fitted onto the bowl 12 around the outlet 14. An enclosure 62 is connected to one side of the collar 60 and projects horizontally outwardly therefrom. The enclosure 62 is open at the bottom to provide bottom edges 64 that serve as rails on which the blade 28 is adapted to travel when it has been moved out of its closed position to its open position shown in FIG. 10. During this travel of blade 28 and while at its open position the secondary spring means 44 will continue to exert the aforesaid pressure of lower magnitude against the rails or edges 64.

Attention is next directed to FIGS. 6–9 and 11, 12 and 17 for a description of the actuating means 66 for moving the sealing mechanism 26 to its open and closed positions. A pivot or post 68 is mounted on the flange 18 and secured in place by the screw 70. Mounted on the post 68 for pivotal movement with respect thereto are the lower flush lever 72 and the upper water lever 74. The flush lever 72 has a finger catch 76 that extends upward and over the water lever 74 so that when the user engages the finger catch 76 and pivots it clockwise, both levers will be moved together. Similarly, when the finger catch 76 is released, a torsion spring 78, FIG. 6, will return the water lever 74 to its original position FIG. 7, and because of the overlapping of the finger catch 76, the flush lever will also be returned to the FIG. 7 position. The torsion spring 78 has its one end secured to the water lever 74 by the clip arrangement 80 and its other end is in engagement with the abutment 82 in the flange 84 that is integrally connected to housing 20.

The flush lever 72 is operatively associated with the crank arm 34 to impart the various movements required. For this purpose, the upper end of the shaft portion 36 of crank arm 34 has a cam follower 86, FIG. 17, and a small crank arm 88. The small crank arm 88 has a follower head 90 at its end for traveling in the slot 92 in flush lever 72. The slot 92 is shaped so that when the flush lever 72 is moved clockwise from the position in FIG. 7 to the position in FIG. 8, the small crank arm 88 will not change its radial position, but the cam follower 86 of shaft portion 36 will be engaged by the cam 94 that is located on the underside of flush lever 72 to move the crank arm 34 downward against first spring means 54 so that the lower pressure is applied to the seal member 56, as shown in the FIG. 12 position.

Figures 8, 9:
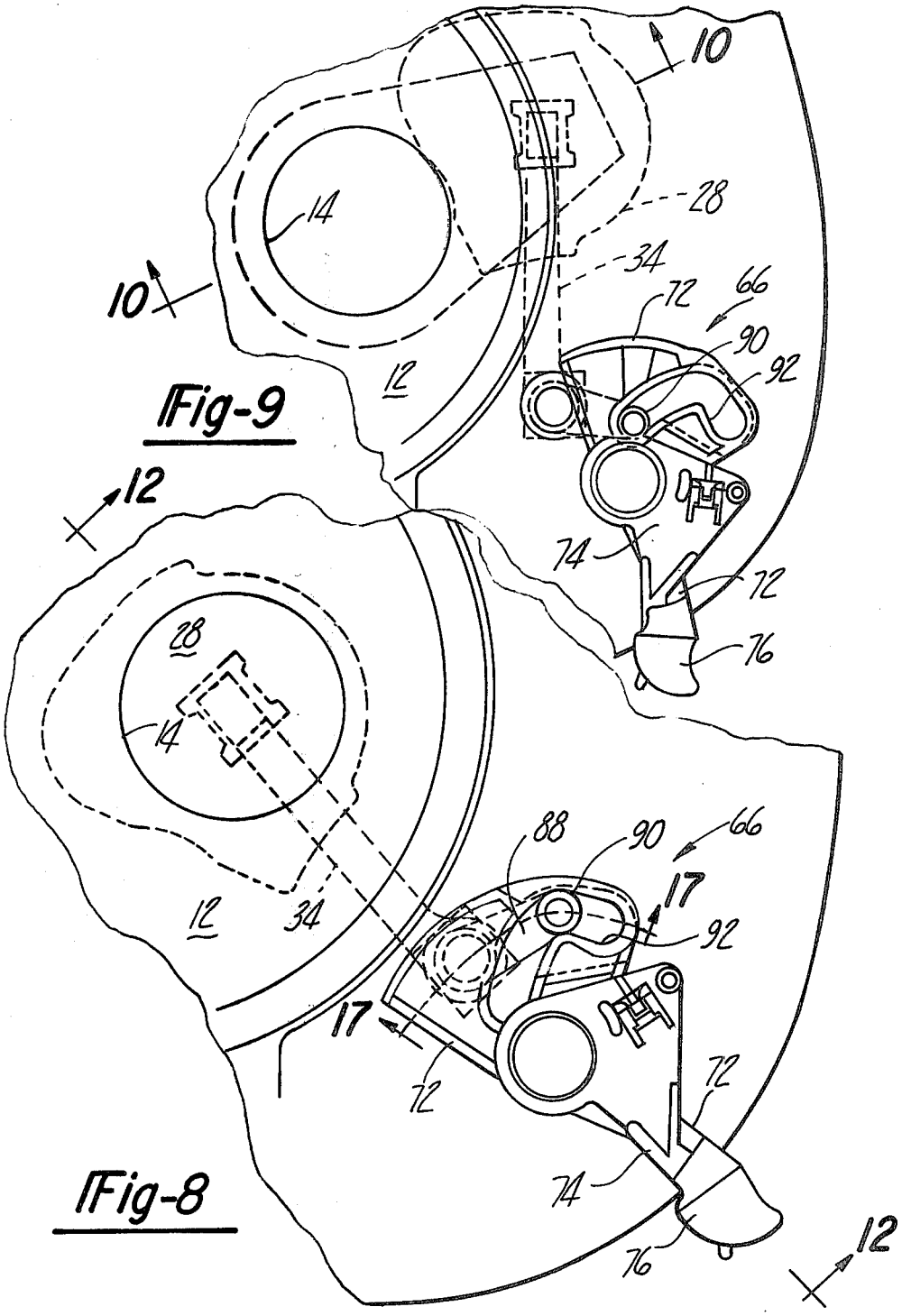
FIG. 8 is a similar view but showing the flush and water levers moved to a location wherein the actuator arm has been depressed.
FIG. 9 is a similar view but showing the flush and water levers after they have been pivoted to their fully open positions.

Now when the flush lever 72 is advanced further in a clockwise direction, the follower head 90 will continue to travel in slot 92 from the FIG. 8 position to the FIG. 9 position causing crank arm 34 to be pivoted from the closed position to the open position of FIG. 9 and 10.

Figure 7:
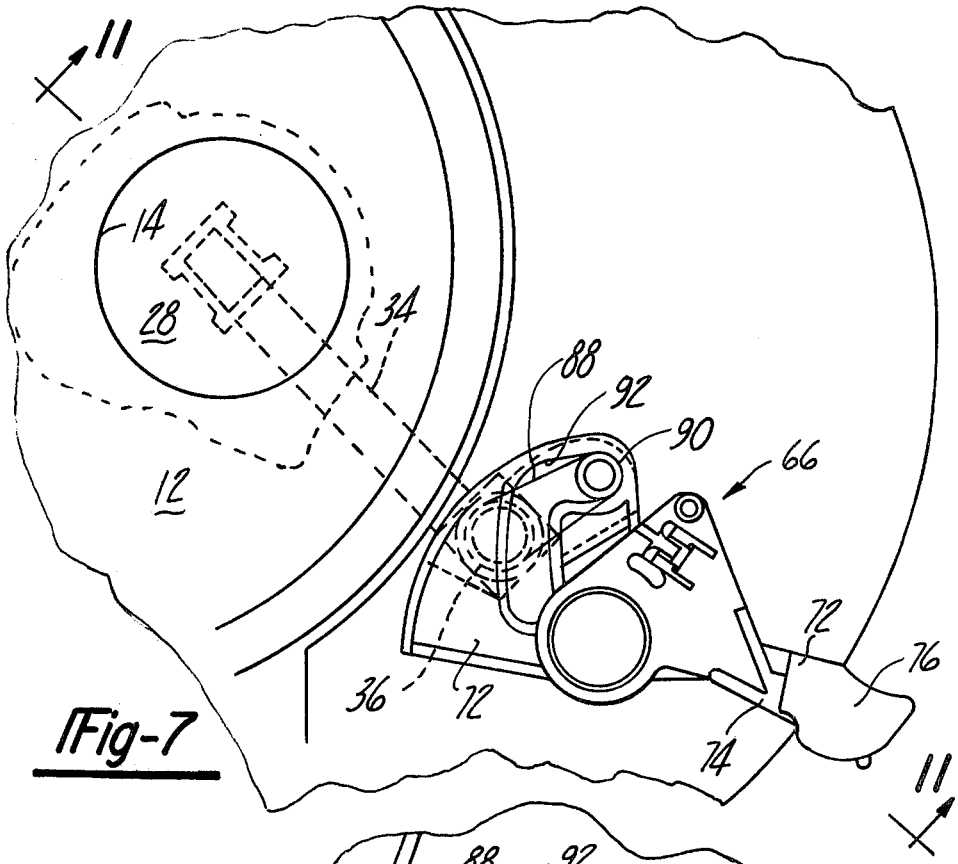
FIG. 7 is a similar view to that of FIG. 6, but showing both the flush and water levers in closed positions.
Figure 6:
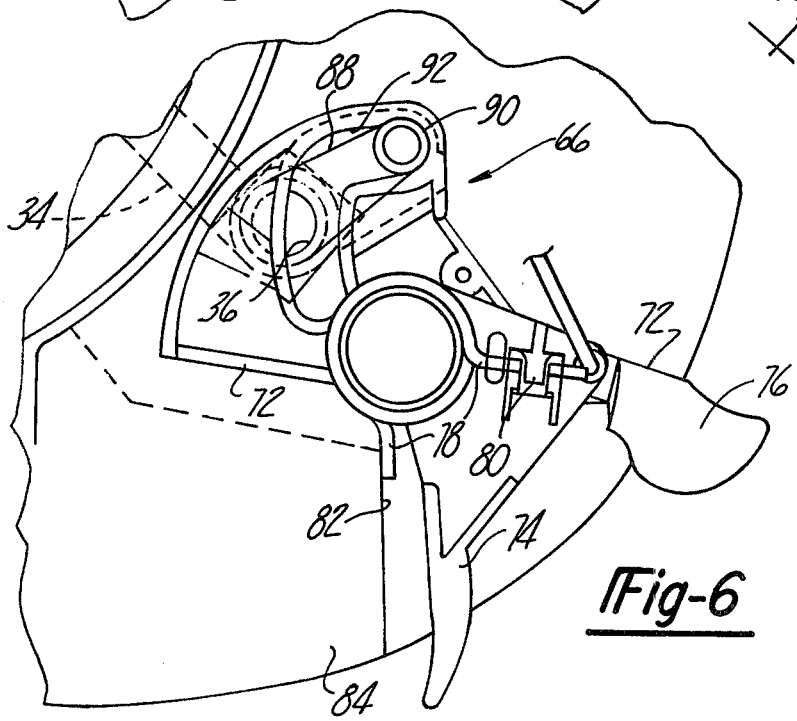
FIG. 6 is an enlarged fragmentary top plan view of the actuator means when only the water level is pivoted to an open position of the control valve.

When the flush lever 72 is released, the lever 72 will be returned to its position of FIG. 7 by operation of torsion spring 78, as was previously described. When this occurs the crank arm 34 will be moved in a reverse order of that described when the flush lever 72 was manually actuated in a clockwise direction.

Figure 5:
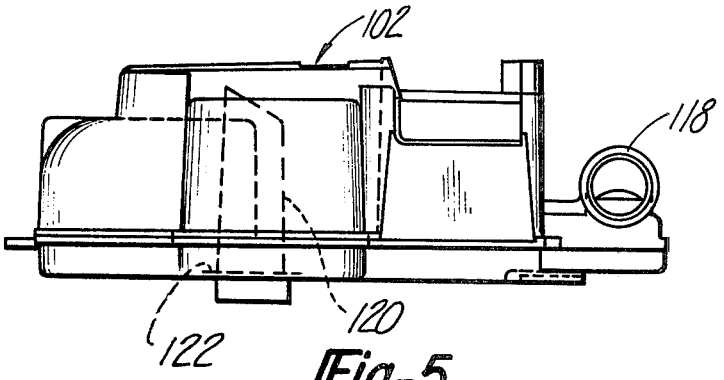
FIG. 5 is a front elevational view of the reservoir, as seen from the arrow 5 but shown apart from the remainder of the toilet apparatus.

Flush means 94 are provided for discharging flush water into the bowl 12 during the flush cycle, including the nozzle 96 for directing the water into the bowl; a control valve 98, FIG. 13, for controlling flow of water from an external source that will be connected to the inlet fitting 100; a water reservoir 102, FIG. 5, into which the control valve 98 directly discharges; and a flush tube 104 that is connected to the outlet of the reservoir 102 and to the nozzle 96.

The water lever 74, previously described, has one end of a linkage 106 connected to it, as shown in FIG. 3, and the other end of the linkage 106 is connected to a crank 108 so that when the water lever 74 is pivoted either with flush lever 72 or indpendently thereof, movement in a clockwise direction will cause crank 108 to pivot causing ball valve element 110 to rotate about its axis to an open position, allowing water to flow from the source of supply through the fitting 100, the flow control seal 112, through the conventional vacuum breaker 114 to passageway 116 and into the water reservoir 102 at its inlet 118.

Figure 14:
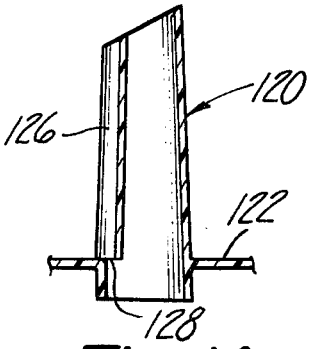
FIG. 14 is a sectional view taken on the lines 14—14 of FIG. 4.
Figure 15:
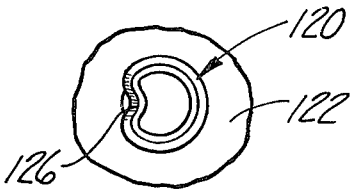
FIG. 15 is a fragmentary top plan view of the riser tube shown in FIG. 14.

The water reservoir is a closed compartment except for the inlet at 118 and an outlet through riser tube 120. As seen best in FIGS. 4, 14, and 15, the riser tube 120 extends through bottom wall 122 of reservoir 102 to a preselected elevation so that when water enters the reservoir 102, the reservoir will be charged with water until the level rises above the opening in the top of riser tube 120 at which time water will be discharged rapidly through the riser tube 120 and into flush tube 124, and from there to nozzle 96.

The riser tube 120 has a groove 126 therein which opens at the bottom to the small orifice 128. After the control valve 98 is closed and the level of the water is at or below the upper end, the remaining water in the reservoir can flow at a slow rate to the nozzle 96. Since the blade 28 will be in its closed position when the control valve 98 is closed, the water that is discharged from reservoir 102 through the orifice 128 will now collect in the bowl 12 to provide a pool therein of a desired depth.

The nozzle 96 is mounted in the bowl 12 to direct a jet of water into the bowl 12 for flow in a vortex pattern. The nozzle 96 has a small aperture 130 therein to allow small quantities of water to descend during flushing into the overflow drain outlet 132 so as to maintain water in the overflow tube 134. The tube is supported adjacent to its midportion by a hook 136, which is molded in the bowl 12; so as to provide a water trap to prevent odors, gases, and the like escaping from the regions below the bowl 12 through the overflow tube 134. The latter has its lower end terminating in the enclosure 62 so that limited quantities of water that flow through the overflow tube 134 can drop onto the blade 28 while the latter is in its open position. A unique feature is the utilization of a check valve 138 at the lower end to prevent the water seal from being broken by back flow or pressure surges that may occur within housing 20.

Another feature of the flush means is the improved control valve which has a valve body 140 with a water inlet end and the tubular fitting 100 has its upper end mounted in the water inlet end in a retained relationship for free rotation about its axis. The fitting has in its midportion an external wrench head 142, preferably hexagonal-shaped to receive a conventional end wrench, said head 142 being adapted to be gripped by the jaws of the wrench. The lower or other end of the fitting 100 is externally threaded at 144 for receiving a fitting associated with a water supply duct (not shown).

The water inlet fitting 100 includes the fitting retainer 146 which snaps into the valve body 140 and is secured by the two barbed fingers 148 that engage the valve body 140 in the slots 150, and disallow rotary and axial movement of the fitting retainer within the valve body.

The water inlet fitting 100 is axially secured in the fitting retainer 146 by means of a continuous barbed radial flange 152 which has an outside diameter slightly larger than the inside diameter of the retainer ledge 154 allowing the barbed radial flange to pass through the ledge during insertion as the semi-flexible retainer ledge material expands slightly but preventing reverse movement. The water inlet fitting is further sealed to the valve body 140 by engaging the seal 112. Thus, the water inlet fitting 100 is free to rotate while maintaining a sealing condition with the valve body 140 so that the valve body 140 is protected from breakage which could result from over-tightening of a water supply fitting (not shown) without corresponding counter-torque being applied to the water inlet fitting 100. Removal of the fitting retainer 146, and thus the fitting from the valve body 140 can be accomplished by radially depressing the two barbed fingers 148 until they are disengaged from the slots 150 in the valve body 140.

It is claimed:

1. Toilet apparatus comprising a bowl having at its bottom a discharge outlet, a housing supporting said bowl, flush means for discharging flush water into said bowl, and a sealing mechanism for closing and opening said bowl outlet, said sealing mechanism having a seal member mounted on said bowl around said bowl outlet and projecting downward below the lower extremity of the outlet, a blade of larger area than said bowl outlet, and an actuator arm for movement of the blade between a first position wherein said blade is located under said bowl outlet and is urged upward at a pressure of relatively high magnitude into engagement with said seal member for closing the bottom of the bowl and a second position wherein said blade is at one side of said outlet, characterized in that actuating means for opening and closing the bowl outlet are operatively associated with said actuator arm and said blade, said actuating means being operable when actuated for opening said bowl outlet to reduce initially the magnitude of the upward pressure of the blade on the sealing member to a pressure of lower magnitude and thereafter to move said blade substantially horizontally toward said second position while the pressure of lower magnitude exerted by the blade on the sealing member is maintained.

2. Toilet apparatus that is defined in claim 1, and further characterized in that said actuating means is operable when initially actuated for closing said bowl outlet to move said blade substantially horizontally to said first position while the pressure of lower magnitude is exerted by the blade on the sealing member and thereafter upon further actuation to increase the magnitude of the upward pressure exerted by the blade on the sealing member to said relatively high magnitude.

3. Toilet apparatus that is defined in claim 2, and further characterized in that said actuating means is movable to first and second locations, a primary spring means is operatively mounted between said actuator arm and said housing for urging said actuator arm upward against said blade at the pressure of higher magnitude when said actuating means is in its first location, and a secondary spring means is operatively mounted between said actuator arm and said blade for transmitting said pressure of higher magnitude from said arm to said blade and thereby to said seal member when said actuating means is in its first location, said actuator arm being displaced in a downward direction when said actuating means is in its second location to reduce the upward pressure transmitted from said arm to said secondary spring means, and said secondary spring means then moving said blade upward and transmitting said pressure of lower magnitude to said blade and thereby to said seal member.

4. Toilet apparatus that is defined in claim 1, and further characterized in that said actuating means is a part of said flush means and comprises a flush lever pivotally mounted on said housing, and said actuator arm has a shaft portion mounted on said housing for rotary movement for moving the blade between its first and second positions, said shaft portion also being movable axially a limited amount in a vertical direction, said actuator arm being spring biased in an upward direction for applying upward pressure at said relatively high magnitude against said blade, and said flush lever and the upper end of said shaft portion are operatively interconnected so that when said flush lever is initially pivoted in one direction of rotation the shaft portion will be depressed by the flush lever while the shaft arm maintains the blade in its first position and thereafter as the flush lever is further pivoted the shaft portion will be pivoted around its axis so that the shaft arm moves the blade to its second position.

5. Toilet apparatus that is defined in claim 4, wherein said flush means includes a valve for controlling flow of water from a source to said bowl, and the toilet apparatus is further characterized in that a water lever is pivotally mounted on said housing and is operatively associated with said flush lever so that when said flush lever is pivoted in said one direction said water lever will be pivoted simultaneously in that one direction to open said valve.

6. Toilet apparatus that is defined in claim 5, and further characterized in that said water lever is also operable independently of said flush lever for opening said valve independently of operation of said sealing mechanism.

7. Toilet apparatus that is defined in claim 5, and further characterized in that said water lever is spring biased to pivot to its closed position and to engage said flush lever and to pivot it in its other direction of movement to close said sealing mechanism.

8. Toilet apparatus comprising a bowl having at its bottom a discharge outlet, a sealing mechanism for closing and opening the bowl outlet, said sealing mechanism having a blade mounted for movement between a first position where the blade is located under said bowl outlet for closing the outlet and a second position where the blade is located at one side of said bowl outlet, flush means for discharging flush water into said bowl, a tube assembly having its one end in communication with said flush means for receiving a limited quantity of flush water during the flush cycle of the toilet apparatus, said tube assembly having its other end located adjacent to the top surface of the blade when the blade is in its second position for discharge of said limited quantity of water onto said top surface of the blade, the midportion of said tube assembly being supported in an elevated position so that a water trap is provided upstream thereof, characterized in that said other end of the tube assembly has a check valve to prevent return flow or pressure surges from occurring in said tube assembly.

9. Toilet apparatus that is defined in claim 8, and further characterized in that an enclosure is mounted adjacent to said bowl outlet immediately above said second position of said blade and in a position to receive water discharged from the other end of said tube assembly, said enclosure being open at the bottom so that water discharged into the enclosure will flow onto the top surface of said blade, said enclosure providing tracks on which the upper surface of the blade travels when moving to and from its second position.

10. Toilet apparatus that is defined in claim 9, wherein said sealing mechanism includes a seal member that encircles the bowl outlet and has a skirt projecting downward below the lower extremity of the outlet, and further characterized in that said tracks are in a horizontal plane passing through said skirt, and spring means urge said blade upward into engagement with said skirt and said tracks when said blade is in its first or second positions.

11. Toilet apparatus that is defined in claim 9, and further characterized in that said other end of the tube assembly is located within said enclosure, and said check valve is mounted at said other end to prevent return flow from the enclosure to the tube assembly.

12. The toilet apparatus that is defined in claim 9, and further characterized in that a collar is fitted onto said bowl around said bowl outlet, and said enclosure is connected to one side of said collar and projects horizontally outward therefrom.

13. Toilet apparatus comprising a bowl having at its bottom a discharge outlet, a housing supporting said bowl, and flush means for discharging flush water into said bowl, said flush means including a control valve mounted on said housing and adapted for controlling flow of water through the flush means to the bowl, characterized in that said control valve has a valve body defining a water inlet, and a tubular fitting has its one end mounted in retained relationship in said water inlet for free rotation about its axis, said fitting having in its midportion an external wrench head to be gripped by the jaws of a wrench and at its other end external threads to which another fitting associated with a water supply duct can be connected tightly only when said wrench head is gripped by the jaws of said wrench.

14. Toilet apparatus that is defined in claim 13, and further characterized in that said valve body has at least one axial slot in the portion thereof that defines said water inlet, a retainer is mounted on the outer side of said fitting for rotational but against axial movement with respect thereto, said retainer having at least one finger for snap-fitting into said axial slot so that said fitting and its associated retainer can be snap-fitted into the water inlet of said valve body and will be retained therein for free rotary movement of the fitting.

15. Toilet apparatus comprising a bowl having at its bottom a discharge outlet, a sealing mechanism for closing and opening the bowl outlet, said sealing mechanism having a blade mounted for movement between a first position where the blade is located under said bowl outlet for closing the outlet and a second position where the blade is located at one side of said bowl outlet, and flush means for discharging flush water into said bowl, said flush means including a nozzle for directing flush water into said bowl, a control valve for controlling flow of water from an external source to said nozzle, and a flush tube in communication with said nozzle for delivering flush water to the nozzle, characterized in that a water reservoir is positioned in communication with the outlet of said control valve and the inlet of said flush tube, said water reservoir being closed except for communication with said control valve and said flush tube, the communication with said flush tube being provided by a riser tube extending through the bottom wall of the reservoir and having its upper end open to the interior of the reservoir a preselected elevation above the bottom wall so that when said valve is open flush water can fill said reservoir to the level of said upper open end after which rapid flow of flush water to the nozzle will occur, said tube having a small orifice adjacent to said bottom wall so that after said valve is closed and the level of water is at or below said upper open end the remaining water in the reservoir can flow at a slow rate to said nozzle.

16. Toilet apparatus that is defined in claim 15, and further characterized in that actuating means are provided for operating said sealing mechanism for movement of the blade to its open and closed positions, said actuating means also being connected to said control valve for opening and closing said control valve when said blade is being opened and closed so that said reservoir will supply a desired length of water on the bottom of said bowl subsequent to closing said control valve.

17. Toilet apparatus that is defined in claim 16, and further characterized in that an overflow tube is provided having its upper end in communication with the interior of said bowl for receiving a limited quantity of flush water from said nozzle during the flush cycle of the toilet apparatus, said overflow tube having its lower end located adjacent to the top surface of the blade when the blade is in its second position for discharge of said limited quantity of water onto said top surface of the blade, the midportion of said overflow tube being supported in an elevated position so that a water trap is provided upstream thereof, said lower end of the overflow tube having a check valve to prevent back flow into said overflow tube.

* * * * *

UNITED STATES PATENT OFFICE

CERTIFICATE OF CORRECTION

Patent No. 4,185,340 Dated January 29, 1980

Inventor(s) Frank T. Sargent; Arthur W. Henke; John M. Antos; John T. Cameron

It is certified that error appears in the above-identified patent and that said Letters Patent are hereby corrected as shown below:

Column 10, line 41, "length" should read --depth--.

Signed and Sealed this

*Nineteenth* Day of *August 1980*

[SEAL]

*Attest:*

SIDNEY A. DIAMOND

*Attesting Officer*

*Commissioner of Patents and Trademarks*